US008469761B1

(12) United States Patent
Disanto et al.

(10) Patent No.: US 8,469,761 B1
(45) Date of Patent: Jun. 25, 2013

(54) APPARATUS AND METHOD FOR RAPID SEALING OF A FLAT PANEL DISPLAY

(75) Inventors: Frank Disanto, Melville, NY (US); Denis Krusos, Melville, NY (US)

(73) Assignee: CopyTele, Inc., Melville, NY (US)

( * ) Notice: Subject to any disclaimer, the term of this patent is extended or adjusted under 35 U.S.C. 154(b) by 191 days.

(21) Appl. No.: 12/924,422

(22) Filed: Sep. 27, 2010

Related U.S. Application Data

(63) Continuation of application No. 11/704,170, filed on Feb. 8, 2007, now Pat. No. 7,883,389.

(51) Int. Cl.
*H01J 9/00* (2006.01)

(52) U.S. Cl.
USPC ..... 445/24; 445/60

(58) Field of Classification Search
USPC ..... 445/24, 60
See application file for complete search history.

(56) References Cited

U.S. PATENT DOCUMENTS

| | | | |
|---|---|---|---|
| 2002/0030435 | A1 | 3/2002 | Sato et al. |
| 2002/0180342 | A1 | 12/2002 | Yamada et al. |
| 2004/0080261 | A1 | 4/2004 | Yokota et al. |
| 2006/0250565 | A1 | 11/2006 | Enomoto et al. |
| 2007/0197120 | A1 | 8/2007 | Lee |

*Primary Examiner* — Anh Mai
*Assistant Examiner* — Andrew Coughlin
(74) *Attorney, Agent, or Firm* — Law Office of Carl Giordano, PC

(57) ABSTRACT

A method and apparatus is disclosed for rapidly joining a first glass substrate to a second glass substrate. The first glass substrate and second glass substrates are separated by a peripheral glass spacer or frame. The glass frame is sandwiched between the first and second substrates. A layer of glass frit is placed on the top and bottom surfaces of the frame or about the top and bottom peripheral edges of the substrates in contact with the frame. Heat is then applied substantially solely to the periphery of the substrates about the frame to cause the frit to melt thereby securing the top substrate to the bottom substrate.

10 Claims, 3 Drawing Sheets

APPARATUS AND METHOD FOR RAPID SEALING OF A FLAT PANEL DISPLAY

RELATED APPLICATIONS

This application is a continuation of and claims priority to U.S. application Ser. No. 11/704,170, filed on Feb. 8, 2007, now U.S. Pat. No. 7,883,389 the entire contents of which are hereby incorporated by reference herein.

FIELD OF THE INVENTION

This application relates to an apparatus and a method for sealing a flat panel display utilizing a concentrated heat source and pressure system.

BACKGROUND OF THE INVENTION

Flat panel display (FPD) technology is one of the fastest growing display technologies in the world, with a potential to surpass and replace cathode ray tubes in the near future. As a result of this growth, a large variety of FPDs exist, such as field effect emission displays (FED), vacuum fluorescent displays (VFD) and thin cathode ray tube displays (CRT), which range from very small virtual reality eye tools to large hang-on-the-wall television displays.

The FPD contains a pair of generally flat glass plates typically rectangular in shape connected together through spacers or side members. The FPD requires a hermetically sealed vacuum envelope formed by sealedly joining the flat plates. The thickness of the relatively flat structure formed with the two plates and the intermediate connecting spacers is much smaller compared to the diagonal length of either plate. In order to provide a vacuumized display one has to bond one glass plate to another leaving a space there between, which space is eventually evacuated.

Basically the flat panel display has two glass sheets bonded to each other about the periphery with the central hollow area containing a vacuum. One or both of the glass plates in certain FPDs may have active components such as TFTs formed thereon and positioned within the hollow of the display.

Thus constructed the glass plates are made of thin glass each having a thickness as small as, for example, about 0.5 to 3.0 mm and are spaced from each other at an interval as small as 0.2 mm, resulting in the envelope being highly reduced in thickness. The typical air evacuation of the envelope is in a range of exceeding $10^{-7}$ Torr so that the electrons emit with efficiency. The process to seal and to evacuate gases to insure vacuums exceeding $10^{-6}$ Torr level is largely achieved by creating an air tight envelope using heat sources to fuse the side spacers to the anode and the cathode substrates using frit (sealing glass) and then using a pump to evacuate the air. Thereafter, a getter absorbs the balance of residual gas maintaining the envelope at a vacuum equal to or exceeding $10^{-7}$ Torr (See for example, Cho, et al U.S. Pat. No. 6,109,994).

Generally the sealing procedure for FPD displays is accomplished by applying a glass frit to the seal area between the support members and the anode substrate and cathode substrate and applying appropriate pressure to the envelope to firmly hold the glass layers that are to be sealed in intimate contact while the entire assembly is subjected to high temperatures in an oven. FIGS. 1*a*, 1*b* and 1*c* are illustrative of the prior art wherein at the assembly point shown in FIG. 1*a*, spacers such as by way of example spacers 109 and if utilized in certain FPD displays various inner spacer walls 106 are positioned to be mounted on glass anode substrate 160. Frit 102 situates along the lower edges of outer spacer walls 109 that contact substrate 160. The frit 108 situates along outer spacer walls 109 that contact the substrate 110. An evacuation tube (not shown) typically affixes to the backplate of substrate 110 or a side plate member 109 for later evacuation of gases from the sealed FPD.

As illustrated in FIG. 1*b* substrates 160, 110 and spacers 109 and if utilized spacers 106 are placed in a fixture, jig or alignment system 220 having clamping members 225, and brought into physical contact along frit 102,108, which sit between members 160,110 and member 109. Fixture system 220 is placed in an oven 235. After being aligned and brought into contact along frit 102,108 (FIG. 1*a*), members 160, 110, 109, and 106 are slowly heated in air to a sealing temperature ranging from 450° C. to greater than 600° C. When the frit 102,108 melts, the oven temperature is then ramped up slowly over a period of 30 minutes to the desired sealing temperature (between 350° C. and 450° C.). The oven 235 holds the temperature constant for approximately 30 minutes. After maintaining the appropriate temperature for the desired time the oven 235 decreases the temperature to ambient over approximately 3 to 4 hours. As the members cool down, composite member 160, 110, 109, and 106 are permanently sealed.

Upon achieving thermal stability at the ambient temperature the FPD is removed from oven 235 and the fixture 220. The pressure in the interior of the FPD is decreased to the desired vacuum level by removing air through the evacuation tube (not shown). The evacuation tube is then closed. FIG. 1*c* illustrates the final hermetically sealed FPD. The sealing procedure as described produces wasted heat energy, unnecessarily exposes the internal components of the display to high temperatures and is time consuming. These practices reduce the reliability of the display and reduce suitability for mass production.

SUMMARY OF THE INVENTION

The present invention pertains to apparatus for use in manufacturing an FPD display by fusing spacers interposed between a first glass substrate and a second glass substrate using a heating mechanism such as an infrared or resistive heater or heat strip to concentrate heat energy along a peripheral rim of the substrates that constitutes the glass sealing areas of the display.

According to an aspect of the present invention, a method and apparatus is disclosed for rapidly joining a first glass substrate to a second glass substrate. The first glass substrate and second glass substrates are separated by a peripheral glass spacer or frame. The glass frame is sandwiched between the first and second substrates. A layer of glass frit is placed on the top and bottom surfaces of the frame or about the top and bottom peripheral edges of the substrates in contact with the frame. Heat is then applied substantially solely to the periphery of the substrates about the frame to cause the frit to melt thereby securing the top substrate to the bottom substrate. Heat is applied in one configuration through a heater element and heat conductive frame which is positioned on the top surface of one of the substrates and which frame conducts heat generated by a strip heater. In another configuration, heat is applied to the peripheral seal via infra-red lamp heaters or by infra-red lamp heaters.

One embodiment the present invention comprises a heat source such as a heat strip in substantially direct contact with a rimmed surface area forming the top outer periphery of a glass substrate and a clamp that subjects the substrate to a normal pressure while the heat source heats the substrate. A heat source is incorporated into a holding apparatus that in one embodiment applies pressure to the substrate while concentrating heat directly on the seal area. Since the temperature or heat decays in intensity as a function of the distance away from the seal area the image area of the display is not exposed to high temperatures. This is of great advantage when one of the glass substrates includes active components such as transistors which may be destroyed by heat produced by conventional prior art methods. For example, using the present method and system in forming a display which utilizes one or more TFTs employing amorphous silicon is particularly advantageous in preventing degradation of the TFT performance associated with high temperature exposure.

According to another aspect of the present invention a method comprises the steps of: (a) pre assembling two glass substrates interposed by one or more glass spacers; (b) applying a frit glass to one or more of the glass substrates and spacers where the substrates and spacers are in contact; (b) positioning a heat source over an outer peripheral area of one of the glass substrates and above the area where one of the substrates and associated spacers are in contact; (c) applying pressure to the glass substrate; (d) applying heat to the outer peripheral area of the one of the glass substrates to melt the glass frit; and (e) cooling the glass substrates and the spacers to thereby fuse the glass substrates to the spacers. The foregoing eliminates the requirement for an oven in the assembly process reducing the overhead cost of assembly.

BRIEF DESCRIPTION OF THE DRAWINGS

It is to be understood that the accompanying drawings are solely for purposes of illustrating the concepts of the invention and are not drawn to scale. The embodiments shown in the accompanying drawings, and described in the accompanying detailed description, are to be used as illustrative embodiments and should not be construed as the only manner of practicing the invention. Also, the same reference numerals have been used to identify similar elements.

DETAILED DESCRIPTION OF THE INVENTION

It is to be understood that the figures and descriptions of the present invention have been simplified to illustrate elements that are relevant for a clear understanding of the present invention, while eliminating, for the purpose of clarity, many other elements found in typical FPD systems and methods of making and using the same. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Figure 1A:
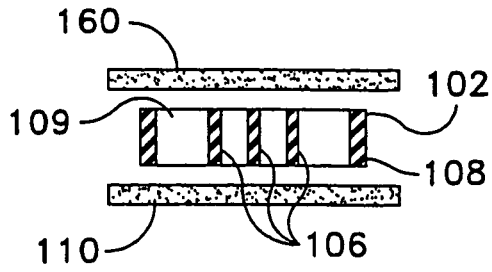
FIG. 1A (PRIOR ART)
FIG. 1*a* illustrates the prior art display pre assembly showing the top and bottom substrates and spacers.
Figure 1B:
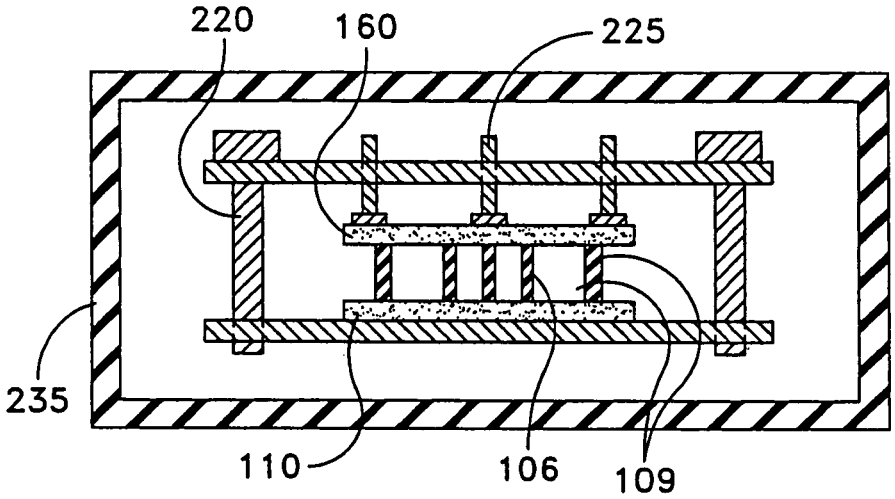
FIG. 1B (PRIOR ART)
FIG. 1*b* illustrates the prior art display assembly showing the top and bottom substrates and spacers clamped in place as inserted into an oven.
Figure 1C:
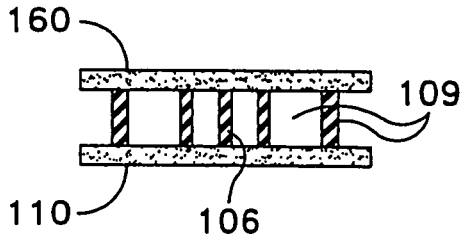
FIG. 1C (PRIOR ART)
FIG. 1*c* illustrates the prior art display assembly showing the top and bottom substrates and spacers as bonded by a combination of applied pressure and heat.
Figure 2B:
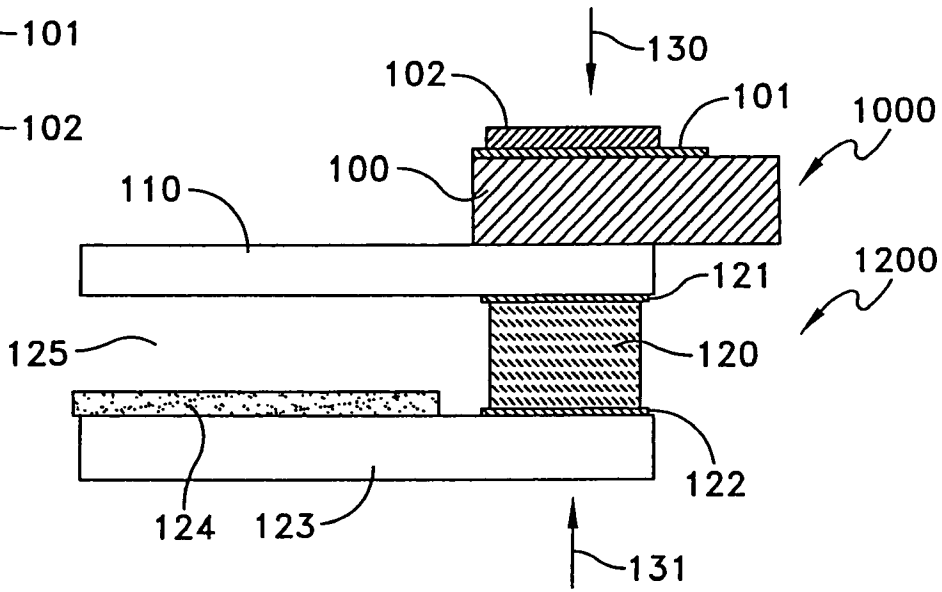
FIG. 2 consisting of FIGS. 2A and 2B illustrates a top and cross-sectional view, respectively, of a display device assembly according to an embodiment of this invention.
Figure 2A:
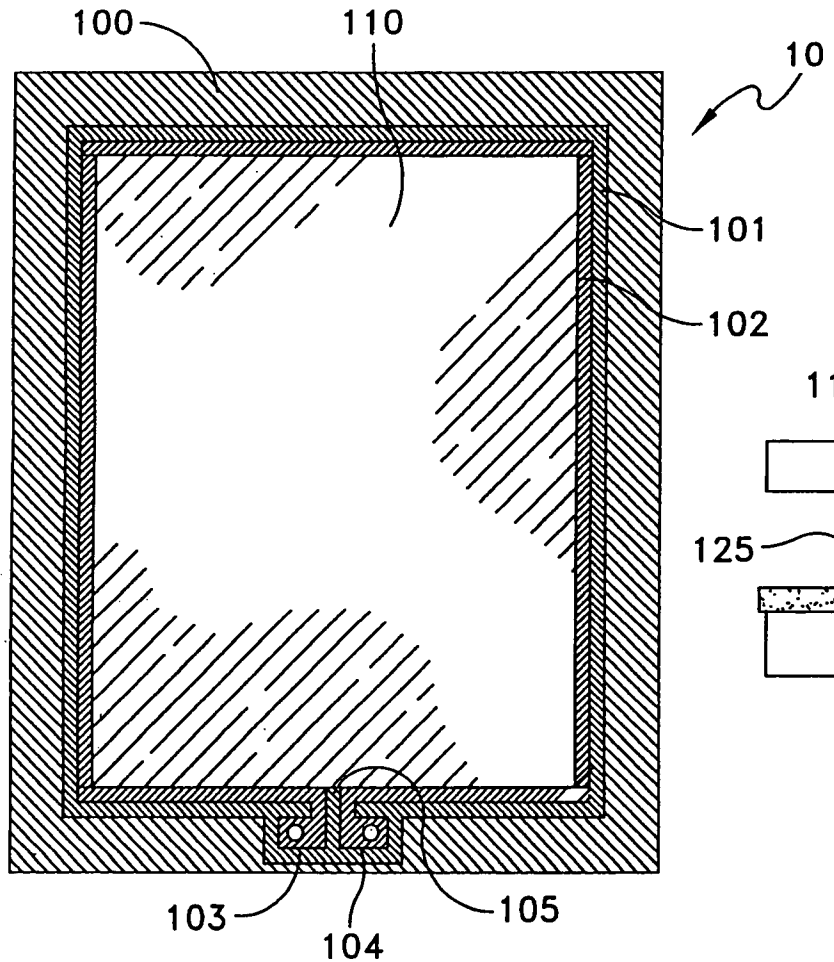
Figure 3:
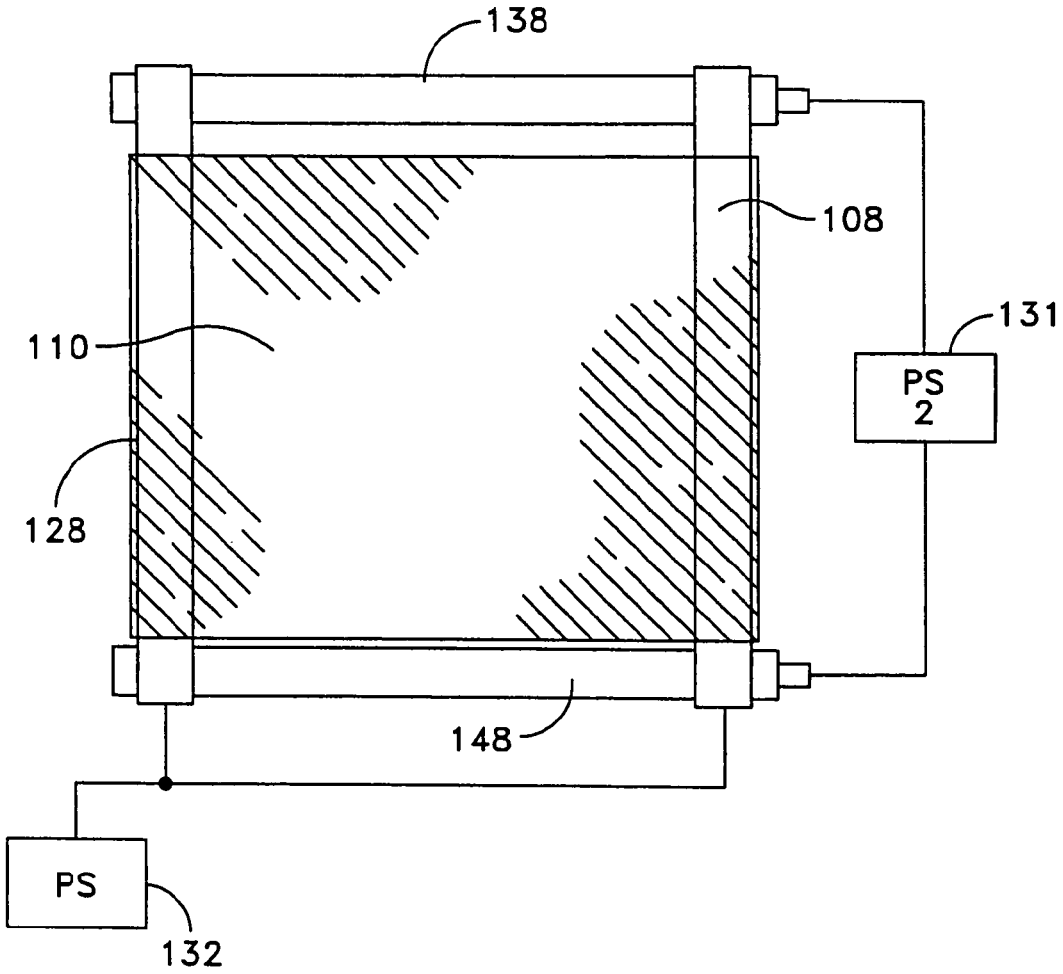
FIG. 3 illustrates a top plan view of an alternate heating device according to another embodiment of the present invention.

In accordance with an aspect of the present invention, and referring to the drawings of FIGS. 2A and 2B, there is shown a method and apparatus for rapidly joining a first glass substrate 110 to a second glass substrate 123. The first glass substrate and second glass substrate are separated by a peripheral glass spacer 120 or frame. The glass spacer or frame 120 is sandwiched between the first and second substrates. A layer of glass frit 121, 122 is placed on the top and bottom surfaces of the frame 120 or about the top and bottom peripheral edges of the substrates 110, 123 in contact with the frame 120. Heat is then applied substantially solely to the periphery of the substrates about the frame to cause the frit to melt thereby securing the top substrate to the bottom substrate. As shown in FIG. 2B, heat is applied through a heat conductive frame 100 which is positioned on the top surface of one of the substrates 110, 123 (e.g. substrate 110) and which frame 100 conducts heat generated by either a strip heater 102. Alternatively, as shown in FIG. 3, infra-red lamp heaters may be used in place of the strip heater 102 along with elimination of heat conductive frame 100. The system and method of the present invention reduces the processing time considerably and enables an efficient, mass production assembly line for forming such flat panel displays. In particular, due to the directed heat transfer applied according to the present invention, the process time is reduced to approximately 1-2 minutes. The system may be automated using fixtures to precisely place the structure relative to the heat assembly and accurately direct the heat pattern to melt the glass frits.

Referring more specifically to FIG. 2A, there is shown a top-plan view of a heating structure or apparatus 10 for assembling two glass substrates one to the other and sealing the substrates. Reference numeral 100 represents a heat conductive frame located about the periphery of the glass substrate. Heat conductive frame 100 is preferably a rigid, heat conductive material such as steel. In one configuration, the heat conductive frame comprises a stainless steel material, however, other such heat conductive, rigid materials may be used, such as aluminum or other metallic having sufficient rigidity to enable proper clamping of the assembly. Glass substrate 110 represents a top glass substrate while substrate 123 (see FIG. 2B) represents a bottom glass substrate for an FPD. In one configuration the two glass substrates operate as anode/cathode substrates respectively for an FPD. In another configuration, such as a nanotube configuration, one of the glass substrates, such as substrate 123 operates as the anode (i.e. no cathode configuration) while top glass substrate 110 is simply a viewing glass that maintains the vacuum for the structure. The heating structure or apparatus 10 consists generally of a heating assembly 1000 and a flat panel assembly 1200 and is shown in cross view in FIG. 2B. Steel frame 100 surrounds the periphery of the glass substrates (with the exception of gap 105) and acts as a peripheral frame. A dielectric 101 such as a dielectric film composed of a typical dielectric which can be silicon dioxide, fiberglass, or many other dielectric materials, operates to electrically isolate the heater element 102 from the frame. Since the frame is also typically made of an electrical conductor (e.g. steel), placing the heater element (which may also be steel) directly on top of the electrically conductive steel frame will cause a short circuit. Hence, dielectric 101 is disposed between the frame and the heater element.

Referring to FIG. 2A the heat conductive frame 100 surrounds substantially the entire peripheral edge of the two glass substrates to be joined together. These substrates are shown in FIG. 2B as substrates 110 and 123. One of the substrates such as substrate 123 may have disposed thereon a plate which contains thin-film devices as active devices such as transistors or other active devices. It is an aspect of the present invention to rapidly seal the plates together while concentrating the majority of heat at the periphery and therefore preventing any heat from entering the internal hollow 125 formed between the plates. As one can ascertain based on the above, the spacing 125 is extremely small and may be on the order of a few tenths of a millimeter and for example can be anywhere from 0.2 to 1 mm, while the thickness of the glass plates can be anywhere from 0.5 to 2 mm. In any event, as seen in FIG. 2B disposed also about the periphery is a glass frame 120. The glass frame 120 may be comprised of individual glass members as side members which are secured together or the frame may be integrally formed. Coated onto the top and bottom surface of the glass frame 120 are layers of glass frit 121 and 122. Glass frits are well known and are widely available from many sources. Such frits typically consist of a mixture of glass particles secured together in a typical holding substance and basically appear like a paste. Upon application of heat the glass beads secured within the holding medium melt and after melting serve to secure the glass substrate 123 to glass substrate 110. The entire assembly is clamped about its periphery as shown by arrows 130 and 131 by a clamping mechanism such as spring clamps, C-clamps or other conventional clamp/retaining mechanisms, as is understood in the art. The pressure imposed by the clamps is suitable to hold the assembly together while the heating elements are turned on. As seen heating element 102 has inter-terminals 103 and 104 with a space 105 there between. Sufficient current is applied to the terminals to enable heat from heating element 102 to be produced in an amount sufficient to melt the glass frit. Such assemblies, which include the heater element, dielectric material and heat conductive frame, for example, are available from various sources and can be sold as a package. One such example comprises a dielectric material, steel frame and heater strip as provided by OOOAKSEO Co. of Moscow, Russia. Various frits may also be employed, including but not limited to model SCB-4 from SEM-COM Co. of Toledo, Ohio. Another type of suitable frit which can be employed for borosilicate glass is model LS-1301 or LS-3705 from NEG Co. located in Tokyo, Japan. Typically, the glass frits are fabricated so they match the thermal co-efficient of the glass substrate. Glass substrates 110 and 123 fabricated from borosilicate glass are suitable for use with the NEG frits as indicated above, for example. Other types of glasses may also be employed with other types of frits as understood by one skilled in the art.

Thus, as seen in FIGS. 2A and 2B the invention operates to produce heat, substantially strictly about the periphery of the glass frame structure and the heat operates to secure the substrate 110 to substrate 123, leaving a hot internal hollow 125 between the substrates.

Referring to FIG. 3 there is shown an alternate embodiment of the invention. The configuration of FIG. 3 is substantially identical to the configuration depicted in FIG. 2 with the exception that instead of using the strip heater element 102 and heat conductive frame 100 one utilizes assemblies of infra-red lamps. These lamps can be typical commercial infra-red lamps having a slit adapted to concentrate the heat output from the lamp onto the intended seal area. This may be accomplished by providing a coating that reflects the IR heat output only through the slit. Such infra-red slit lamps are sell known in the art. As seen, there is an infra-red lamp on each side of the frame, as for example, lamp 128 for the left side, lamp 138 for the top side, lamp 108 for the right side and lamp 148 for the bottom side. The infra-red lamps apply infra-red heat to the flat panel assembly and the heat operates again to melt the frit 121 and 122 (FIG. 2B). The structure depicted in FIG. 3 substitutes the infra-red lamps for the heater element 102. In this exemplary embodiment, a weight is applied to the top glass substrate sufficient to hold the flat panel assembly in place while heating is applied. The heating lamps, in the configuration of FIG. 3, are not in the same plane. For example, lamps 128 and 108 may be closer to the frame than lamps 138 and 148 due to the format. In order to accommodate the difference in distance of the lamps from the frame one can energize the lamps by means of different power levels. Thus, lamps 138 and 148 for example, will receive power from a power source designated as PS2 or source 131. Separate lamps as 128 and 108 are energized from power source 132. By controlling the amount of current furnished to the lamps from the respective power sources, one can better control the distribution of power to the lamps as a function of the distance of the infra-red lamps from the flat panel assembly. Thus the lamps that are closest to the frame which may be for example 138 and 148, would receive less power than the lamps which are further from the frame such as lamps 108 and 128. It is of course understood that the positions of the lamps can be substituted. Power supplies 131 and 132 are shown for powering the lamps by way of example. However, it is understood that a single power supply may be employed with suitable resistors operating to reduce the power to each of the displays.

Infra-red lamps which can be employed in conjunction with the present invention are for example, model no. QH-2201000 manufactured/distributed by OAO-LISNA located in Saransk, Russia (e.g. 220 volt, 1000 watt lamp). Other infra-red lamps for commercial heating purposes are well known and may also be employed.

Thus, as seen above, there is described a rapid sealing technique sealing two glass substrates one to the other about the periphery to create an internal hollow between the substrates. The internal hollow can be vacuumized by conventional techniques as is well known. The entire composite assembly 1200 (FIG. 2B) of the two plates is secured together by selective heating of the periphery of the assembly, wherein the first plate is joined to the second plate by peripheral heating. Peripheral heating is accomplished by a heat assembly 1000 disposed relative to the flat panel assembly 1200 and adapted to direct heat substantially only to the periphery of the assembly 1200 so as to directly heat the area of the glass frit. In one embodiment, the heat assembly comprises a heat conductive frame which receives heat from a heating strip element. A dielectric material is disposed between the heating strip element and the heat conductive frame, which frame transfers heat from the heating element to the top glass substrate and to the glass frits so as to melt the frits and join the top and bottom glass substrates and the glass spacer. A retainer or holding or clamping mechanism retains the assembly while selective heating is applied. In an alternate embodiment selective heating is accomplished by infra-red slit lamp assemblies 108, 128, 138, 148 (FIG. 3) which are directed along the periphery of the flat panel assembly. In one embodiment, infra-red slit lamp assemblies are disposed at the top, bottom and at the right and left sides of the flat panel assembly. Since one set of lamps may be closer (i.e. closer in vertical separation of the lamp from the surface of the top glass substrate) to the assembly than the other set of lamps, the infra-red lamps receive different power levels so that the heat generated is equivalent based on the separation of the lamps one from the other.

It can thus be seen that there would be many alternate embodiments which will be discerned by those skilled in the prior art and all such embodiments are deemed to be encompassed within the spirit and scope of the claims appended hereto.

What is claimed is:

1. A method of assembling a display comprising the steps of:

(a) interposing a glass spacer between a top and a bottom glass substrate;

(b) applying a frit glass to the top and bottom substrates and the spacer;

(c) positioning a heat source over an outer peripheral area of the first glass substrate, said heat source comprising a plurality of infra-red lamps positioned about the outer periphery of said display, wherein a first infra-red lamp is placed over a top peripheral side and a second infra-red lamp is placed over a bottom peripheral side, a third infra-red lamp is placed over a right peripheral side and a fourth infra-red lamp is placed over a left peripheral side;

(d) applying a pressure to at least one of the top and bottom substrates;

(e) applying heat from the heat source to the outer peripheral area of one of the top and bottom substrates to melt the glass frit, wherein more power is applied to said lamps that are further from said substrates than said lamps positioned closer to said substrate; and (f) cooling the top and bottom glass substrates.

2. The method of claim 1, further comprising disposing a heat conductive frame on the top glass substrate and applying heat from the heat source to the heat conductive frame to melt the glass frit.

3. The method of claim 2, wherein the heat source further comprises a resistive heat strip.

4. The method according to claim 3, further including placing a dielectric layer about the top surface of said frame and placing said resistive heating strip on said dielectric layer.

5. A method of joining a first glass substrate to a second glass substrate, comprising the steps of:

applying a glass frit about a periphery of said substrates to frame a central viewing area of said substrates, placing one or more spacers between said substrates to space said substrates prior to joining them a predetermined distance one from the other, said one or more spacers positioned to contact a glass frit associated with each substrate, providing infra-red lamps having a specific heat pattern about the periphery of said substrates to substantially direct heat to said frame area to cause said frit to melt and join said first glass substrate to said second glass substrate, wherein a first infra-red lamp is placed over a top peripheral side and a second infra-red lamp is placed over a bottom peripheral side, a third infra-red lamp is placed over a right peripheral side and a fourth infra-red lamp is placed over a left peripheral side and applying more power to either said first and second lamps than to said third and fourth lamps, wherein said lamps that are closer to said substrates receive less power than said lamps positioned further from said substrate.

6. The method according to claim 5, wherein the one or more spacers are glass spacers.

7. The method according to claim 6, further including placing a dielectric layer about the top surface of said frame and placing a heating strip on said dielectric layer to heat said heat conductive frame to cause said frit to melt.

8. The method according to claim 7, wherein said heat conductive frame is a steel frame.

9. The method according to claim 5, further comprising:

placing a resistive strip heater and heat conductive frame about the periphery of said placed substrates.

10. The method according to claim 5, further including the step of clamping said substrates prior to the step of heating.

* * * * *